United States Patent [19]

Nückel

[11] 4,326,460

[45] Apr. 27, 1982

[54] INDICATING DEVICE FOR AN OPTION PRINTING CYLINDER

[75] Inventor: Klaus Nückel, Mülheim am Main, Fed. Rep. of Germany

[73] Assignee: Postalia GmbH, Offenbach am Main, Fed. Rep. of Germany

[21] Appl. No.: 175,447

[22] Filed: Aug. 5, 1980

[30] Foreign Application Priority Data

Aug. 7, 1979 [DE] Fed. Rep. of Germany ..... 2932426

[51] Int. Cl.[3] ..... B41J 1/60

[52] U.S. Cl. ..... 101/110; 101/93.12; 235/101

[58] Field of Search ..... 101/110, 111, 109, 66, 101/75, 76, 85, 91, 99, 93.12; 235/101, 437; 400/139-140, 152, 144.2

[56] References Cited

U.S. PATENT DOCUMENTS

| | | | |
|---|---|---|---|
| 1,814,432 | 7/1931 | Conklin et al. | 101/75 |
| 2,707,913 | 5/1955 | Russell et al. | 101/110 X |
| 2,727,687 | 12/1955 | Komusin | 235/101 |
| 3,301,176 | 1/1967 | Lowell | 101/85 |
| 3,334,721 | 8/1967 | Hickerson | 110/110 |
| 3,921,516 | 11/1975 | Toft et al. | 101/91 |
| 4,207,814 | 6/1980 | Schenk | 101/76 |

FOREIGN PATENT DOCUMENTS

| | | | |
|---|---|---|---|
| 669825 | 9/1963 | Canada | 101/75 |
| 360051 | 11/1931 | United Kingdom | 101/75 |

*Primary Examiner*—E. H. Eickholt

*Attorney, Agent, or Firm*—Herbert L. Lerner; Laurence A. Greenberg

[57] ABSTRACT

Device for indicating types of mail for an option printing cylinder in franking machines, including side plates disposed on the option printing cylinder, another printing cylinder supported between the side plates in the option printing cylinder, a toothed cylinder gear connected to the other printing cylinder, a device for setting different types of printing upon rotation of the other printing cylinder, a first shaft at least partially disposed in the option printing cylinder, a setting gear rotatably supported on the first shaft, internal and external gearing formed on the setting gear, a second shaft at least partially supported in a hole formed in the first shaft, a gear being fastened on the second shaft and having teeth meshing with the internal gearing formed on the setting gear, and a gear segment having teeth meshing with the teeth of the cylinder gear to rotate and set the other printing cylinder upon rotation of the setting gear.

6 Claims, 1 Drawing Figure

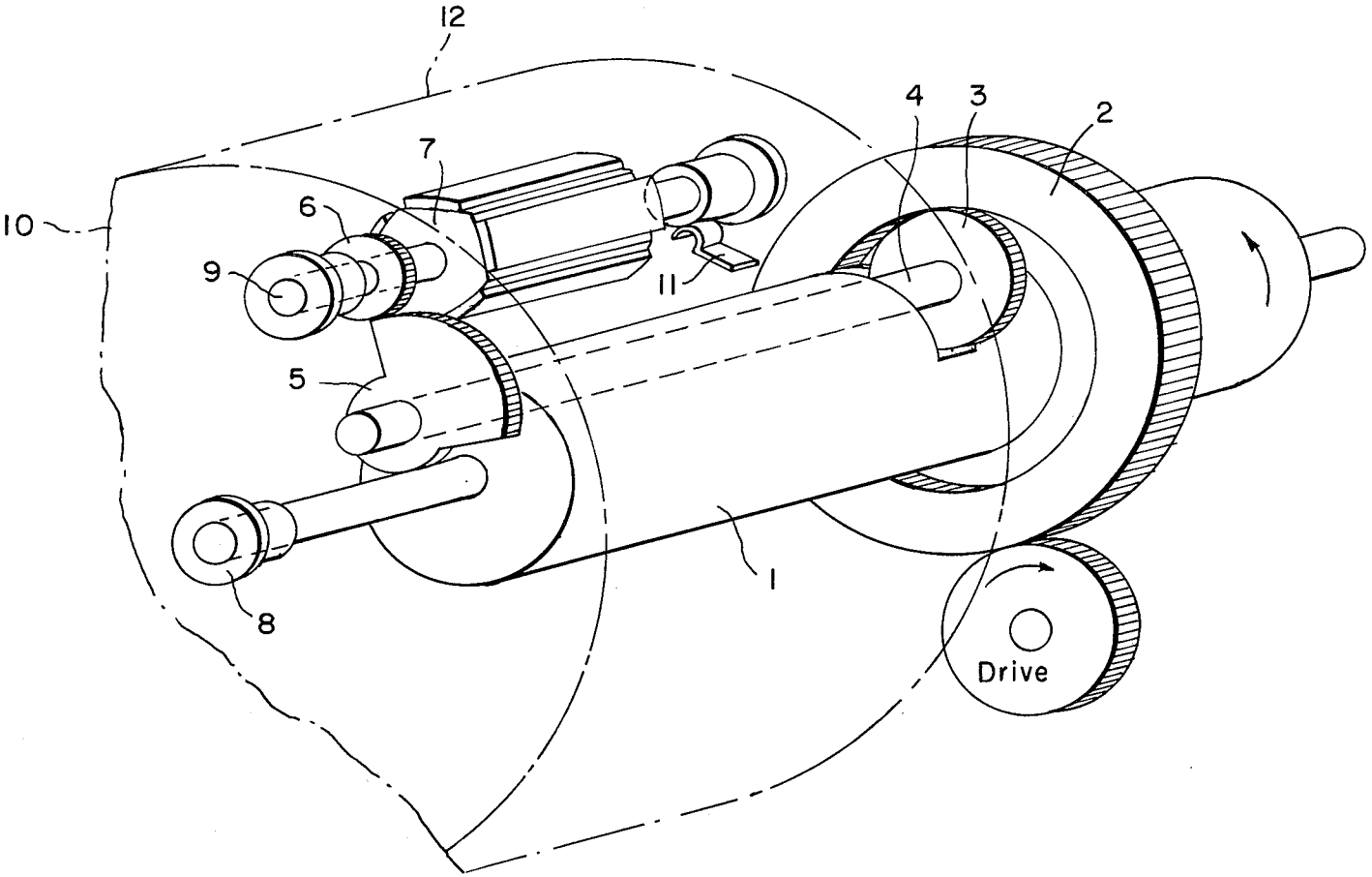
Drive
1
2
3
4
5
6
7
8
9
10
11
12

INDICATING DEVICE FOR AN OPTION PRINTING CYLINDER

The invention relates to a device for an option printing cylinder in franking machines for indicating the type of mail.

Franking machines stamp the well-known franking stamp, including the denomination stamp with the place-of-mailing stamp and the date stamp, as well as a sender and/or advertising stamp on the piece of mail or; on paper strips for pieces of mail of larger dimensions. Such indicating devices are, however, bulky and require a great deal of space.

It is accordingly an object of the invention to provide an indicating device for an option printing cylinder, which overcomes the hereinafore-mentioned disadvantages of the heretofore-known devices of this general type, and which provides, in addition to the known types of stamp, an option printing cylinder for different, settable types of mail, wherein the space required is to be kept small.

With the foregoing and other objects in view there is provided, in accordance with the invention, a device for indicating types of mail for an option printing cylinder in franking machines, comprising side plates disposed on the option printing cylinder, another printing cylinder supported between the side plates in the option printing cylinder, a toothed cylinder gear connected to the other printing cylinder, a detent device for setting different types of printing upon rotation of the other printing cylinder, a first shaft at least partially disposed in the option printing cylinder, a setting gear rotatably supported on the first shaft, internal and external gearing formed on the setting gear, a second shaft at least partially supported in a hole formed in the first shaft, a gear being fastened on the second shaft and having teeth meshing with the internal gearing formed on the setting gear, and a gear segment having teeth meshing with the teeth of the cylinder gear to rotate and set the other printing cylinder upon rotation of the setting gear.

In accordance with another feature of the invention, the gear fastened to the second shaft is guided in a notch formed in the first shaft for preventing axial shifting.

In accordance with a further feature of the invention, the setting device is provided with interchangeable printing types.

In accordance with an added feature of the invention, the other printing cylinder has notches formed therein, and the setting device is provided with a detent spring snappable into the notches.

In accordance with an additional feature of the invention, there is provided a shaft having notches formed therein supporting the other printing cylinder between the side plates, the setting device being provided with a detent spring snappable into the notches.

In accordance with a concomitant feature of the invention, the setting device is provided with a device for locking the other printing cylinder in given rotary positions.

Other features which are considered as characteristic for the invention are set forth in the appended claims.

Although the invention is illustrated and described herein as embodied in an indicating device for an option printing cylinder, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying single FIGURE of the drawing which is a fragmentary diagrammatic perspective view of the features of the device for an option printing cylinder which are essential for the invention.

Referring now particularly to the single figures of the invention, there is seen a printing cylinder settable in five different ways for types of mail which may carry the following printing types: printed matter, printed letter mail, registered and package. The fifth printing type is not designated for normal types of mail. Instead of a printing cylinder with five possible adjustments, any desired number of printing types can also be used. This is limited by the size of the cylinder circumference. In a further embodiment of the invention, the printing types are also interchangeably disposed on the printing cylinder.

The printing cylinder 7 for types of mail is provided in a printing cylinder 12 of a franking machine shown in phantom. The bearing pins of a printing cylinder shaft 9 are disposed in the side plates 10 of the printing cylinder 12. A first shaft 1, having an end which is likewise supported in a side plate 10 of the printing cylinder with a bearing pin 8, carries a setting gear 2 provided with an outer and an inner gear rim. The setting gear 2 is moved in the direction of the arrow by a drive gear as shown. A second shaft 4, which carries a gear 3 at one end and a gear segment 5 at the other end thereof, is supported in a hole formed in the first shaft 1. Both gear elements 3 and 5 are rigidly connected to the second shaft 4 by positive connection, for instance. The gear 3 is guided in a notch formed in the first shaft 1 so that security against axial shifting with a corresponding tolerance is obtained at the same time. Furthermore, no other aids for axial securing are therefore required. The teeth of the gear 2 mesh with the internal gearing of the setting gear 2. By moving the setting gear 2, the gear segment 5 is therefore moved in the same direction. The gear segment 5 engages with the cylinder gear 6 and thus brings about the rotation of the printing cylinder 7. A detent or locking spring 11, which engages either in notches formed in the printing cylinder 7 or in corresponding devices of the printing cylinder shaft 9, ensures an accurate positioning of the printing cylinder 7 for the printing type desired. The printing type itself of the printing cylinder 7 is interchangeable.

There are claimed:

1. Device for indicating types of mail for an option printing cylinder in franking machines, comprising side plates disposed on the option printing cylinder, another printing cylinder supported between said side plates in the option printing cylinder, a toothed cylinder gear connected to said other printing cylinder, means for setting different types of printing upon rotation of said other printing cylinder, a first shaft at least partially disposed in the option printing cylinder, a setting gear rotatably supported on said first shaft, internal and external gearing formed on said setting gear, a second shaft at least partially supported in a hole formed in said first shaft, a gear being fastened on said second shaft and having teeth meshing with said internal gearing formed on said setting gear, and a gear segment having teeth meshing with the teeth of said cylinder gear to rotate and set said other printing cylinder upon rotation of said setting gear.

2. Device according to claim 1, wherein said gear fastened to said second shaft is guided in a notch formed in said first shaft for preventing axial shifting.

3. Device according to claim 1, wherein said setting means include interchangeable printing types.

4. Device according to claim 1, wherein said other printing cylinder has notches formed therein, and said setting means include a spring snappable into said notches.

5. Device according to claim 1, including a shaft having notches formed therein supporting said other printing cylinder between said side plates, said setting means including a spring snappable into said notches.

6. Device according to claim 1, wherein said setting means includes means for locking said other printing cylinder in given rotary positions.

* * * * *